US010515496B2

(12) United States Patent
Zabala Zabaleta et al.

(10) Patent No.: US 10,515,496 B2
(45) Date of Patent: Dec. 24, 2019

(54) ELECTRONIC LOCK AND ELECTRONIC LOCKING SYSTEM FOR FURNITURE, CABINETS OR LOCKERS

(71) Applicant: OJMAR, S.A., Elgoibar-Guipuzcoa (ES)

(72) Inventors: Jon Zabala Zabaleta, Eibar-Guipuzcoa (ES); Aketza Elices Ruiz, Zumaia-Guipuzcoa (ES); Xabier Martinez Amiano, Donostia-Guipuzcoa (ES); Julien Boullie, Hendaya (FR)

(73) Assignee: OJMAR, S.A., Elgoibar-Guipuzcoa (ES)

( * ) Notice: Subject to any disclaimer, the term of this patent is extended or adjusted under 35 U.S.C. 154(b) by 0 days.

(21) Appl. No.: 15/770,081

(22) PCT Filed: Feb. 15, 2016

(86) PCT No.: PCT/ES2016/070086

§ 371 (c)(1),
(2) Date: Apr. 20, 2018

(87) PCT Pub. No.: WO2017/068210

PCT Pub. Date: Apr. 27, 2017

(65) Prior Publication Data

US 2018/0315265 A1 Nov. 1, 2018

(30) Foreign Application Priority Data

Oct. 22, 2015 (ES) ..... 201531147 U

(51) Int. Cl.

| | |
|---|---|
| ***G07C 9/00*** | (2006.01) |
| ***E05B 47/02*** | (2006.01) |
| ***E05B 65/02*** | (2006.01) |
| ***E05B 47/00*** | (2006.01) |
| ***E05B 41/00*** | (2006.01) |

(52) U.S. Cl.

CPC ..... *G07C 9/00309* (2013.01); *E05B 47/0012* (2013.01); *E05B 47/026* (2013.01); (Continued)

(58) Field of Classification Search

None

See application file for complete search history.

(56) References Cited

U.S. PATENT DOCUMENTS 8,662,386 B2 3/2014 Radicella et al.
9,273,492 B2 3/2016 Gokcebay
(Continued)

FOREIGN PATENT DOCUMENTS

EP 0715044 A1 6/1996
EP 2269322 A1 1/2011
(Continued)

OTHER PUBLICATIONS

International Search Report and Written Opinion dated Oct. 10, 2016 for PCT/ES2016/070086.

*Primary Examiner* — Carlos Garcia

(74) *Attorney, Agent, or Firm* — Lucas & Mercanti, LLP

(57) ABSTRACT

Electronic lock and electronic locking system for furniture, cabinets or lockers are disclosed, the electronic lock having a case fixed to the inner part of a door of a piece of furniture, cabinet or locker; a locking element electronically activated; a power supply module; a wireless communication module; an electronic control module operating in different modes of operation: an offline mode to autonomously activate the locking element based on the access data received; an online mode where the access data received are sent to a central control unit and the activation of the locking element is performed based on the activating instructions remotely received from the central control unit, the lock automatically operating in an offline mode under conditions of a failure event in the communications with the central control unit.

16 Claims, 14 Drawing Sheets

(52) U.S. Cl.
CPC ..... *E05B 65/025* (2013.01); *G07C 9/00174* (2013.01); *G07C 9/00571* (2013.01); *G07C 9/00896* (2013.01); *G07C 9/00912* (2013.01); *G07C 9/00944* (2013.01); *E05B 41/00* (2013.01); *E05B 2047/0031* (2013.01); *E05B 2047/0058* (2013.01); *E05B 2047/0065* (2013.01); *E05B 2047/0068* (2013.01); *E05B 2047/0069* (2013.01); *E05B 2047/0094* (2013.01); *G07C 9/00904* (2013.01); *G07C 2009/00373* (2013.01); *G07C 2009/00634* (2013.01); *G07C 2009/00642* (2013.01); *G07C 2009/00769* (2013.01); *G07C 2009/00936* (2013.01)

(56) References Cited

U.S. PATENT DOCUMENTS

2006/0244595 A1 11/2006 Malone et al.
2010/0231350 A1 9/2010 Scharer et al.
2010/0276487 A1 11/2010 Radicella et al.
2013/0298616 A1 11/2013 Ullrich et al.
2014/0292001 A1 10/2014 Nunez et al.
2014/0318199 A1 10/2014 Gokcebay
2015/0070135 A1 3/2015 Ford
2015/0211258 A1 7/2015 Gokcebay
2016/0050191 A1* 2/2016 Alt ..... H04L 63/061 726/4
2017/0221291 A1* 8/2017 Gokcebay ..... G07C 9/00944
2017/0254115 A1* 9/2017 Sotes Delgado ... E05B 47/0012
2018/0291650 A1* 10/2018 Zabala Zabaleta ..... G07C 9/00571

FOREIGN PATENT DOCUMENTS

GB 2236797 A 4/1991
WO 2009128032 A1 10/2009
WO 2014179623 A1 11/2014

* cited by examiner

ELECTRONIC LOCK AND ELECTRONIC LOCKING SYSTEM FOR FURNITURE, CABINETS OR LOCKERS

CROSS REFERENCE TO RELATED APPLICATION

This Application is a 371 of PCT/ES2016/070086 filed on Feb. 15, 2016, which claims priority of Spanish Application No. U201531147 filed Oct. 22, 2015, both of which are incorporated herein by reference.

FIELD OF THE INVENTION

The present invention is included within the field of electronic locks for lockers, cabinets or furniture.

BACKGROUND OF THE INVENTION

Currently, public transport stations, schools, gyms, swimming pools and sport facilities in general are equipped with lockers for users to temporarily keep their personal items. Each locker is provided with an independent lock or locking system, which controls the opening and closing of the locker. The locking systems can be merely mechanical (actuated by means of a key) or electronical (activated, for example, by means of a keypad or an RFID tag).

Regarding lockers fitted with electronic locks, in most cases said locking systems are not connected to any central control unit, but they feature an individual and isolated behaviour instead. Power for the electronic components of these locking systems can be wire-supplied or supplied locally by using a battery in each electronic lock.

In case of a wired power supply, one or more supply wires in the location where the lockers are placed, serve to supply all and each of the electronic locks in the facility at all times, with the advantage of avoiding supply problems except for cases of a general failure in the supply system of the facility or an unlikely fault in any of the supply wires. However, it has the inconvenience that, once the piece of furniture is manufactured, it is difficult for it to be adapted, to create slots or grooves thereon to hide the wiring. If this is not accurately performed, the material left by the user inside the locker can damage the facility. Furthermore, this requires the wires to be distributed all over the facility so as to reach each and every locker, something which is often very expensive and not very feasible depending on where these are to be located.

To avoid the difficult and complicated process of wire supplying each of the lockers in the facility, the chosen option in many cases is to supply the electronic locking systems individually by means of batteries. This forces to individually monitor the charge level of each battery so as to replace it in time before it runs out, which can be complicated and inefficient in facilities having a great amount of lockers.

In other cases the lockers in the facility may be part of a system controlled by a central unit, which allows remote control and configuration of the lockers. In some cases, the locker system is controlled by one or several local units, which are in turn usually connected to a central unit. For example, in some gyms a local unit controls the locking of up to 32 lockers from a display, there being as many displays as blocks of 32 lockers. In these systems centralized systems the electronic locks of the lockers are wire supplied and communicated with the central or local unit also wirelessly. These locker systems do not have power supply problems, since they are wire supplied, and can be managed remotely by the central unit. However, they still have the disadvantage of requiring a costly, and frequently complicated, installation of the supply wires and the communication wires with the central unit.

In the current locker systems featuring centralized control, batteries are not used to supply the locking systems as this is not a practical solution, since the power consumed by the electronic lock operation itself and by the wireless communication with the central unit would force a battery replacement every few days, which makes this option non-viable. These locker systems featuring a centralized control only work "online", being the lockers unable to work in offline mode in case of a failure in the centralized supply and/or in the central unit.

The electronic lock and electronic locking system for the lockers of the present invention solve the above mentioned problem, with power being supplied to the lockers by means of batteries and operation of the lockers being either an offline operation or operation managed by a central unit, having a minimum consumption which makes it possible for the batteries to last for more than two years under normal use conditions.

DESCRIPTION OF THE INVENTION

The present invention refers to an electronic lock and an electronic locking system for furniture, cabinets or lockers comprising a plurality of electronic locks controlled by a central control unit. The invention is particularly appropriate to be used, among others, in lockers from sport facilities, such as public swimming pools or gyms.

The electronic lock of the present invention is battery powered and it can operate offline ("stand-alone" mode), online ("online" mode) or in a combined mode. When it operates online, the lock is managed remotely and wirelessly by a server or central control unit, which is in charge of assigning locks to the users, granting closing and opening authorizations, managing warnings, updating locks programming and configuration, etc. The battery or batteries are placed in a removable compartment which allows an easy and quick replacement of batteries (the entire module can be removed and it does not remain attached to the lock, thus allowing an easy manipulation thereof). Once the replacement or re-charging of the batteries or battery has been performed, these are replaced in the lock and are fastened to the lock, preferably by using a screw which keeps it in place and secures a suitable electric contact.

The electronic lock comprises a case having means for the attachment thereof to the inner part of a piece of furniture, cabinet or locker door, a closing element being electronically activated, a stand-alone power supply module with at least one battery, a wireless communication module (preferably a WiFi module), and an electronic control module.

The electronic control module is configured to operate the lock in any of the following operating modes: an offline mode or an online mode. In the offline mode, the lock activates autonomously the locking element on the basis of the access data received. In the online mode, the lock wirelessly sends access data to a central control unit and activates the locking element on the basis of the activation instructions remotely received from said central control unit, with the lock changing to the offline operation mode under conditions of a failure in the communication with the central control unit.

The electronic lock preferably comprises electronic access means for access data reception, which will usually include at least an identifier or an access code.

In a preferred embodiment, the electronic access means are wireless, and preferably RFID and/or NFC proximity wireless means, comprising in this case an RF antenna and an RFID and/or NFC reader. The RF antenna can be located inside the case or, in the case of lockers with metallic walls, in the through hole of the metallic door of the locker. The RFID and/or NFC reader is preferably configured to periodically energize the RF antenna and, in case of detecting an RFID and/or NFC identification, wake up the lock electronic control module.

The electronic access means may comprise, additionally to the wireless electronic access means or alternatively thereto, a module having means for the attachment thereof to the front side of the door and being configured to communicate with the electronic control module, said electronic access means including at least any of the following elements: a keypad, an infrared reader, a biometric reader.

The electronic lock may also comprise a visible LED at the front side of the door to indicate the lock state.

In a preferred embodiment, the electronic lock communicates wirelessly with the central control unit at the lock request, keeping the wireless communication module deactivated when there is not communication going on.

The electronic lock may comprise means for detecting the lock state being connected to the electronic control module. These detection means comprise a blocking sensor, a locking sensor and an opening sensor to detect three different possible positions of the locking element: open, locked or blocked.

In a preferred embodiment, the electronic lock comprises an automatic opening and locking system for the locking element having a motor and a movable carriage coupled to the locking element at one end, and at the opposite end to a mechanical transmission system in charge intended to transform the rotary movement of the motor into a linear movement of the carriage. The automatic opening and locking system comprises a first elastic element located between the movable carriage and the locking element, the first elastic element featuring relative mobility with respect to the movable carriage in the displacement direction of the movable carriage.

In a possible embodiment, the locking sensor detects the movable carriage when it is in the locking position, the opening sensor detects the movable carriage when it is in the opening position, and the blocking sensor detects the position of the locking element when it is total or partially in the opening position. In this case, the electronic control module is configured to identify the blocking position of the locking element or non-authorized tampering of the lock when the locking sensor detects simultaneously that the movable carriage is in the locking position and the blocking sensor detects that the locking element is in the opening position; or when, simultaneously, the opening sensor detects that the movable carriage is in the opening position and the blocking sensor detects that the locking element is not in the opening position.

The blocking, locking and opening sensors can be implemented by means of optical or magnetic sensors which determine the state of the lock by detecting an arm of the locking element and the opposite end of the movable carriage.

The electronic lock may also comprise a pusher and a blocking trigger. The pusher is coupled to the movable carriage by the insertion of a second elastic element, and it has relative mobility with respect to the movable carriage in the displacement direction of the movable carriage. The blocking trigger rotates around an axis defining a blocking position and an unblocking position, in such a way that when the locking element is in the opening position the blocking trigger is placed in the unblocking position thereof, and when the locking element is in the locking position, the blocking trigger is situated between the locking element and the pusher, the blocking trigger blocking the displacement of the locking element and the pusher acting as a stop for the blocking trigger.

The electronic lock may comprise locked door detection means, which in turn may comprise a magnetic sensor of the 'reed' type housed in a cavity drilled in the side wall of the case in which the locking element is located, said magnetic sensor being connected to the electronic control module so as to determine if the door is locked by detecting a magnet fixed to the inner side wall of the piece of furniture, cabinet or locker.

The electronic control module may be configured to identify non authorized tampering of the piece of furniture, cabinet or locker by detecting the door opening when the locking element is in a locked position, and to generate a warning alarm.

The electronic lock may comprise an ultrasonic sensor or a volumetric sensor of the PIR type located at the rear part of the case and connected to the electronic control module to detect if the inner part of the piece of furniture, cabinet or locker is empty or full.

The present invention also refers to an electronic locking system for furniture, cabinets or lockers. The system comprises a plurality of electronic locks as those previously described and at least a control unit communicated with the electronic locks. The control unit or units are configured to, upon receiving the access data sent wirelessly by an electronic lock, verify if said access data grant access to operate the electronic lock, and send to the electronic lock the activation instructions on the basis of said verification.

In a preferred embodiment, the control unit is implemented as a central control unit. In another embodiment, the control unit is implemented as a plurality of distributed control units. The electronic locks and the control unit or units may form a local or wide area configurable network.

The electronic lock is provided with a configuration that makes it possible to reduce the power consumption to a minimum, dramatically increasing the battery duration, obtaining a lock which is in stand-by most of the time. The electronics of the electronic lock is in stand-by most of the time, and it is provided with wake up means to wake the electronics up when the user acts upon the lock or in case of vandalism, thus obtaining a dramatic reduction of the battery consumption.

The electronic lock has other additional advantages. In the first place, the electronic lock is made up of a single module, which highly facilitates the mounting thereof. Furthermore, the lock is mounted in the inner part of the piece of furniture or locker door, instead of in the frame, since it does not require a supply wire or communication wire to communicate with the main server. In this way it allows easy upgrading of stand-alone electronic or mechanical locks using in the doors the standard fixing elements already existing, thus easily transforming an existing independent locker system into a locker system with a wireless centralized control. Therefore, mounting of online locker systems is highly simplified, requiring no additional wiring installation or intermediary equipment in the piece of furniture. On the other hand, the online locker system, if so configured, allows access to any electronic lock directly from the Internet without requiring the use of a linking gateway (gateway).

Additionally, the electronic lock opens or closes automatically once it has been activated by the activating means, since it is not provided with an outer handle or pull knob for the manual activation of the mechanism, which allows a smooth appearance of the outer side of the furniture or locker, leaving visible, if the user wishes so, only light indications to assist in using the lock, by indicating if the locker is free (green) or taken (red). One of the difficulties encountered by the locks already known in the art consists of keeping the doors of the free lockers completely closed, since the door always remains a little bit open which affects the appearance thereof. These locks are usually completely standing by and in order to wake up the electronics thereof, the users themselves have to push the door slightly, thereby activating a mechanical switch which, in turn, turns the electronics on, and then the lock can be operated with the RFID access means. This involves two movements from the user, one to turn the lock on and another to bring the RFID key closer. However, in the lock of the present invention the door can be completely closed, and just with one action the user brings the support closer, wakes the lock up and operates with the data from the RFDI key in a single movement from the user.

As an additional advantage, while in the centralized systems the electronic locks of the lockers are permanently wire powered, implying a high electric power consumption of the wired installation, the lock system of the present invention optimizes energy consumption, since the necessary energy for the locks is optimized so that they only consume when an activation or any other functionality is required. The lock preferably comprises a contactless proximity radio frequency identification interface (NFC, RFID), by means of which the lock can be initialized, a master key can be used, data can be retrieved from the lock (such as events, configuration, and state). The electronic lock is preferably activated by means of a passive RFID tag, for example, in the form of a card or bracelet, wherein, so as to operate the lock, the user only has to bring the RFID tag closer and the locker opens or closes automatically, with no additional action required for the user. The present invention also contemplates the possibility to activate the lock by means of devices featuring NFC or RFID technology, for example a mobile phone. Additionally or alternatively, the electronic lock may be provided with other activating means, as for example a keypad or a character keypad, an infrared reader or a code reader. The lock comprises an electronic control module intended to validate the identification of then access means and to control the movement of the locking system of the lock.

The electronic lock is preferably provided with means for detecting the position of the locking element (tab, latch) in three different positions: open, locked or blocked. These detection means are implemented by means of optical or magnetic sensors which allow detection of the tab location (this functionality being equivalent to that traditionally realized by means of mechanical sensors), and the mechanical blocking thereof, by means of transparent windows made in the inner case. The blocking sensor allows detection of locker violation attempts, when someone tries to force the lock to open the door manually moving the tab or latch from the locking position to the open position thereof from outside the locker or furniture. If the blocking sensor detects a minimum movement of the tab, it wakes the electronics up and an alert signal is emitted (e.g., a message to the control station and/or an acoustic and/or light signal from the locker itself).

Optionally, the lock can also be provided with means for detecting a locked door, preferably by means of a magnetic switch of the 'reed' type that detects the presence of a magnet located in the inner area of the furniture. Thus, the sensor detecting the locked door can detect external violation attempts to the locker, when the locker door opens by forcing it (for example, pulling strongly), since in these cases the mechanics of the lock would keep a locked position and however the locker door would still be detected as open if it breaks or if it moves from the locking position thereof. Upon detection of a door violation attempt, the electronic lock would wake up and could emit an alert signal, either a local alert (through a LED and/or a buzzer) and/or a remote alert, transmitting the alert detection to the central control unit.

Optionally, the lock may comprise means to detect the presence of objects in the locker or changes therein, by means of ultrasound. Thus, the lock may incorporate at the rear part thereof, at the opposite side of the locker door, an ultrasonic sensor or equivalent. Upon installing the lock in the furniture, an automatic initial calibration of the sensor must be done according to the furniture volume in which the lock is installed. Using this sensor a posteriori, it can be detected if the locker is empty (with no objects inside thereof) or taken (with an object within). With this information, the electronic lock control module (or the central control unit if the lock is in the online mode) can prevent the locking of empty lockers or emit an alert if a locker remains taken after the closing time of the facility, so as to make the tasks of maintenance and management of the facilities easier.

BRIEF DESCRIPTION OF THE DRAWINGS

The following is a brief description of a series of drawings which will help understand the invention better and which specifically refer to an embodiment of said invention presented as a non-limiting example thereof.

DETAILED DESCRIPTION OF THE INVENTION

The present invention refers to an electronic lock for furniture, cabinets or lockers, and an electronic locking system comprising a plurality of electronic locks controlled by a central unit. The electronic locks of the system are powered by a battery and communicate wirelessly with a central control unit, which can be operated as follows:

- "Offline" or "stand-alone" mode: each lock works autonomously, featuring autonomous decision making about when to open or lock the locking element.
- "Online" mode: the locks communicate wirelessly with the central control unit, which decides about opening or locking the different locks.
- Combination mode: the locks are operated in a mixed mode, normally online, but if there is a failure in the communication with the central control unit, it automatically enters the offline mode.

As well as performing traditional opening and locking operations, the system online operation of the locks makes it possible for several maintenance actions to be carried out, such as:

- Upgrading of the firmware so as to provide more functionality or to correct mistakes remotely without requiring a maintenance operator to perform the operation manipulating the locks one by one.
- Planning a schedule for batteries replacement according to the actual level of the batteries. With this information actions can be taken according to the real data of each lock. Similarly, if there is a failure in the locks, these alert the central control unit, thus facilitating the maintenance tasks.
- When an attempt to force the locker is detected, the central unit receives a real time warning and thus suitable security actions can be taken. For example, it can be decided to open the locker so as to prevent it from being damaged or broken, make the lock emit a sound alert and notify the police from the central unit.
- Locks can be assigned to users from the central unit for an online, offline or combination operation thereof. This makes it possible to choose the lockers and thus improve the user comfort.
- The locks can incorporate an object detecting sensor inside the locker, so this can provide functionalities for planning the collection of used material (e.g., used towels in spa changing rooms).

The electronic locking system consists of a plurality of electronic locks.

Figure 1A:
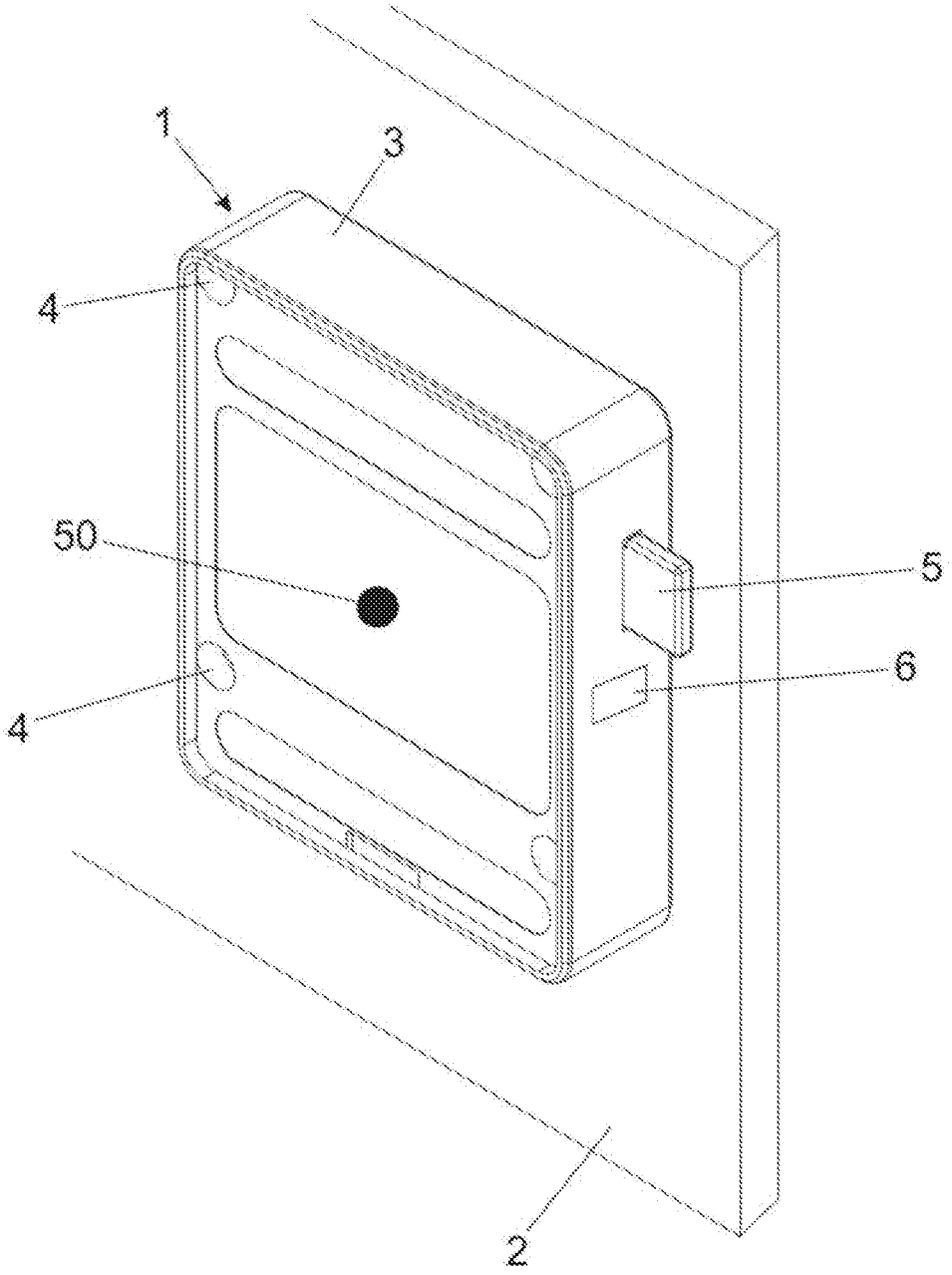
FIG. 1A shows an electronic lock according to the present invention mounted in the inner side of a furniture or locker door.

FIG. 1A shows, according to the present invention, an embodiment of an electronic lock 1 mounted inside a furniture or locker, fixed in the inner part of the locker door 2. As it can be appreciated in the figure, the electronic lock comprises a single module. All the electronic and mechanical components of the electronic lock 1 are located inside an outer case 3, attached to the door 2 by means of fixing screws which pass through holes 4 of the case 3. The electronic lock 1 is provided with a retractable locking element 5 (e.g., a latch or a tab) activated by means of a motor to allow the locker door 2 to open or lock. The locking element can be activated electric or electronically; that is, the activation thereof is automatic, without manual operation. The lock is also provided with a cavity 6 which houses a magnetic sensor (for example, a 'reed' switch), the role of which will be explained further below.

Optionally, the electronic lock 1 can incorporate, at the rear part thereof, an object detecting system by means of an ultrasound sensor 50 connected to the control element to detect if the locker is empty or taken (i.e., with any object within). Upon installing the lock 1 in the locker, the ultrasound sensor 50 is calibrated according to the locker volume. The lock ultrasound sensor 50 is calibrated when the locker is empty or taken, by scanning with the ultrasound sensor 50 from the control element and verifying the response times to different frequencies. During normal operation of the lock, with the information provided by the ultrasound sensor 50, the electronic lock detects if a certain threshold is exceeded, starting from the value measured during calibration in the furniture, preventing empty lockers from being locked or emitting an alert if a locker remains taken after the closing time of the facility. A possible application of the ultrasound sensor 50 would be that of periodically verifying, when the lock is locked, if the locker is taken or not. In order to do this, the scanning is repeated with the same frequencies as those used during the calibration, either periodically or after a request sent from the central unit to the lock and if the response deviation exceeds a given threshold, an alert is triggered and/or the locker door 2 is opened, as defined. With this, it is possible to determine the locked lockers having objects left inside at the closing time of the facility, making it possible for the user of the locker or for an employee with a master key to unblock the locker and recover the objects left behind.

Alternatively to the ultrasound sensor 50, there can be used infrared volumetric sensors, of the PIR type, which detect the infrared reflected from the objects. These would be used in a similar way to the ultrasound sensor, carrying out a calibration when empty or taken and verifying if the sensor measurement is above a given threshold.

Figure 1B:
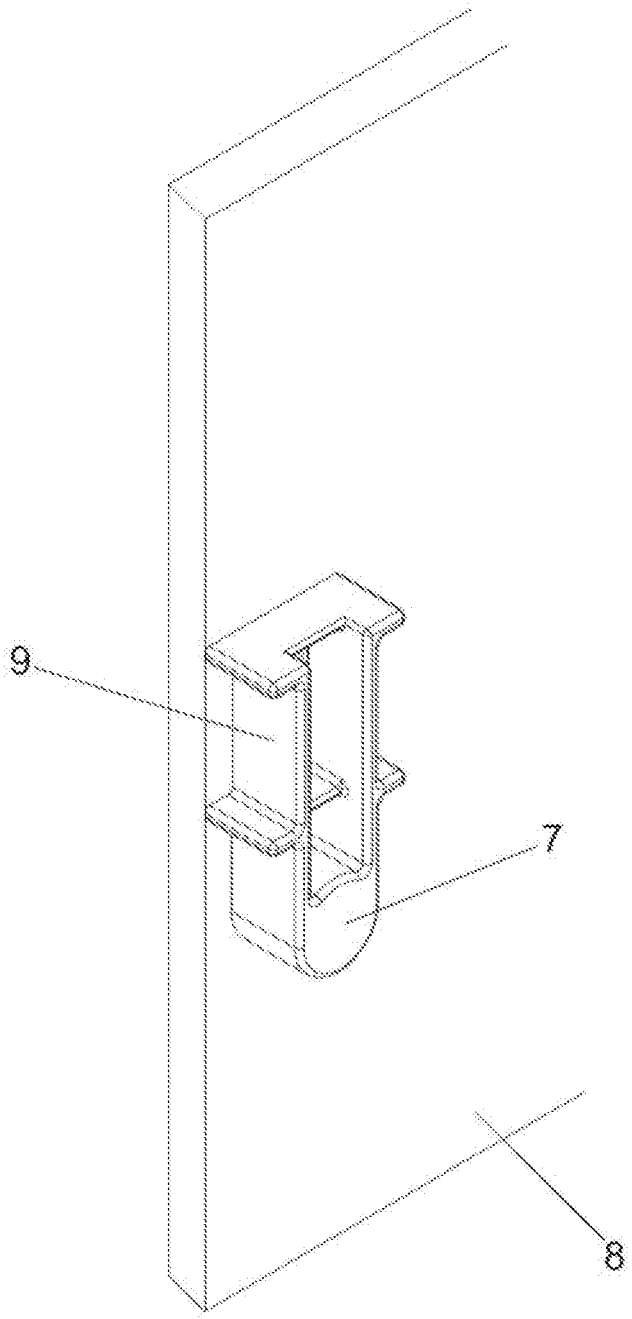
FIG. 1B shows a view of the inner side wall of the furniture or locker.

FIG. 1B shows a view of the inner side wall of the furniture. The locking element 5 of the electronic lock 1 is inserted, once it is extended, into an outer groove 9 attached to or hollowed out from the inner side wall 8, thus preventing the door to be opened. The locking element 5 can also use the furniture profile itself as a fastening element.

To detect if the locker door 2 is locked, the electronic lock 1 is provided with a magnetic sensor installed in the cavity 6 drilled in the side wall of the case 3, in which the locking element 5 is located (in the case shown in FIG. 1A the cavity 6 is located just underneath the locking element 5). The magnetic sensor is intended to detect a magnet 7 fixed to the inner side wall 8 of the piece of furniture, as it can be seen for example in FIG. 1B, at the same height as the magnetic sensor. When the movement of the locking element 5 is activated for the lock to be locked, the lock 1 makes an attempt to detect the magnet 7 presence by means of the magnetic sensor. If it detects the magnet 7, the lock considers that there is a correct operation, since the locking element 5 and the door 2 are locked. If the magnet is not detected 7, this implies that the locking element 5 is locked but the door 2 is open, thereby stating that there is an incorrect operation which can be indicated with visual (led) or sound (buzzer) means and/or alerting the management staff by sending an email to the central unit, thus notifying the user that the locker is not correctly locked.

Figure 1C:
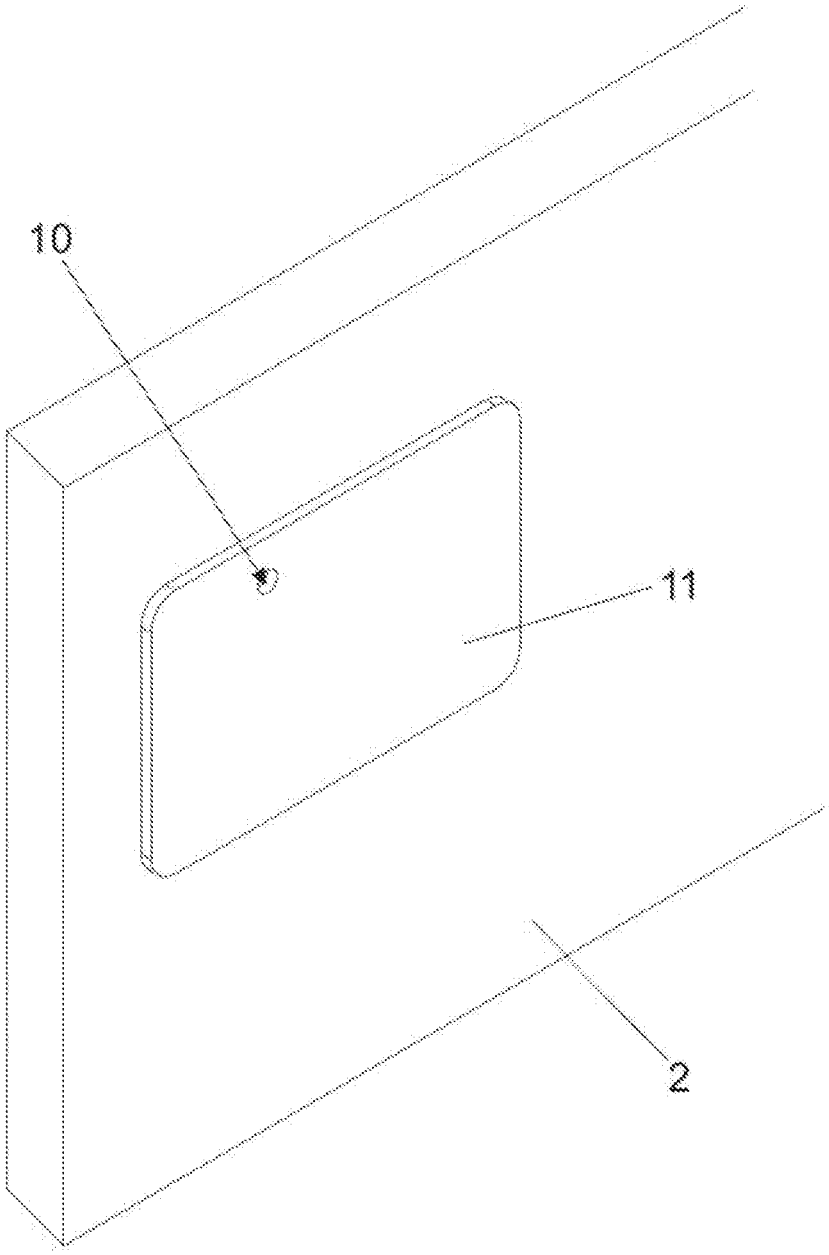
FIG. 1C shows a front view of the locker door with the lock installed.

FIG. 1C shows, according to a possible embodiment, the external appearance of the locker door 2, in a front view. The lock features automatic locking and unlocking, so it does not require an activating element (knob, handle, outer pull knob) for the user to activate the latch or tab. According to the embodiment shown in FIG. 1C, activation of the lock by the user is done wirelessly, by using an RFID tag (e.g., an RFID card or an RFID bracelet). Thus, in the visible part of the outer side of the door 2 there is only a LED 10 and an indication 11 which indicates where the user has to hold the RFID key close to (the RFID antenna of the electronic lock 1 is located inside the door at that height). The electronic lock 1 can use alternative access means, which the user can interact with so as to operate the lock, for example a keypad or a biometric reader or an infrared receptor installed at the front side of the locker door 2, so the outer appearance of the lock 2 can vary. In these cases, the lock comprises two modules connected to each other: an outer identification module and the lock components included in the case 3. Likewise, the lock could include a display or different light signals (e.g., several LEDs), or it could also include no light signals at all. The lock can even include no electronic access means at all in the hypothetical case that the identification is performed in another device (for example, in a wall reader, or in a telephone, or in a computer). In the last case, the lock can go without the access means. The lock wirelessly receives the command for the opening or locking action from the central unit or the device containing the access means.

Figure 2A:
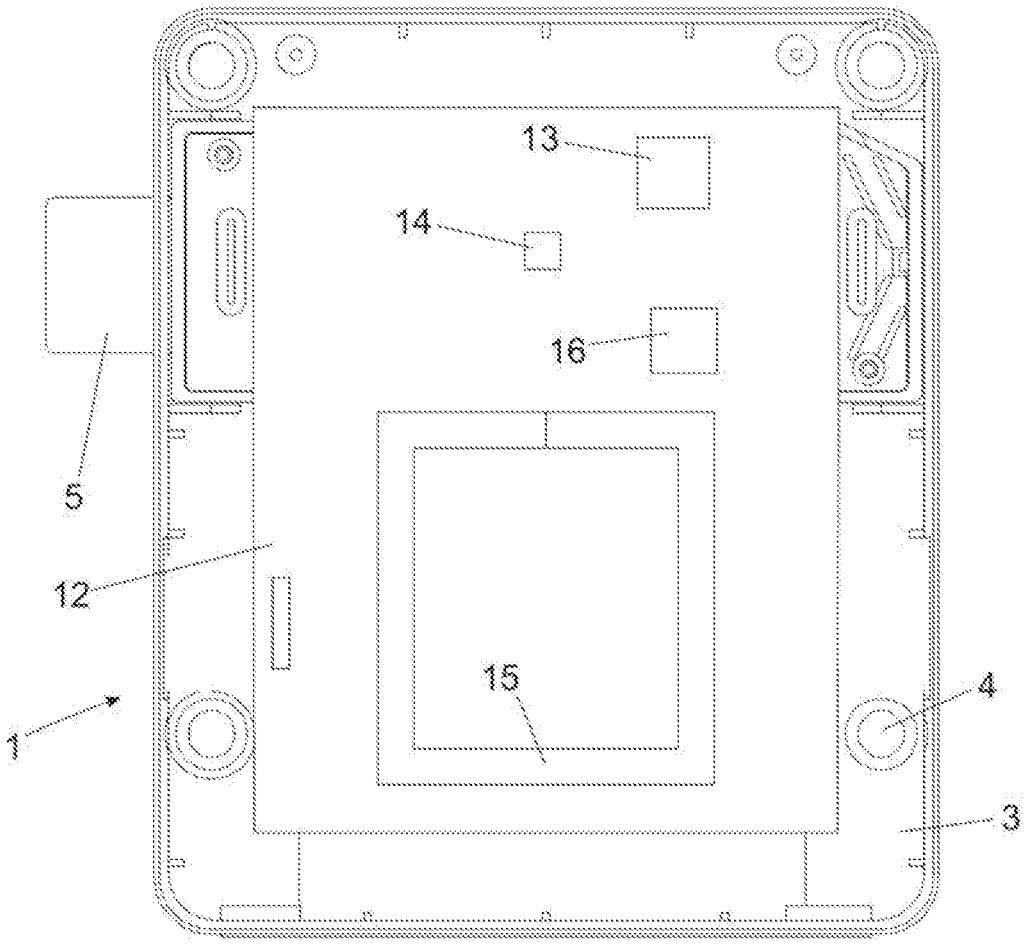
FIGS. 2A and 2B show, respectively, a front and perspective view of the inner part of an electronic lock, showing a printed circuit board and the different electronic components thereof.
Figure 2B:
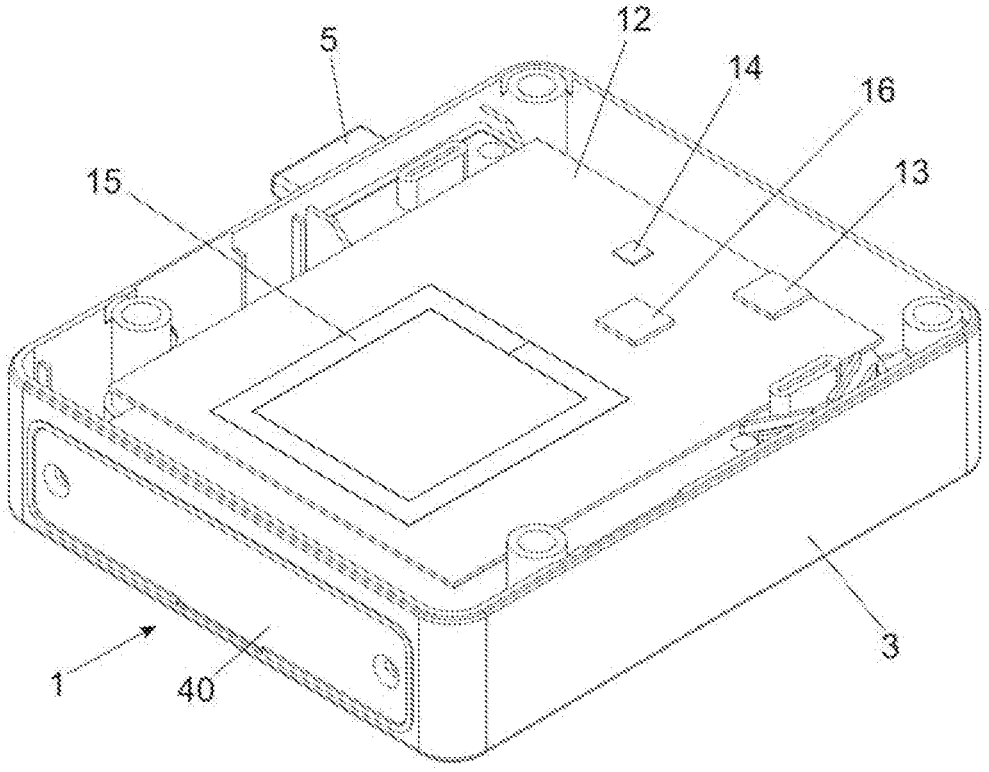

FIG. 2A shows an inner front view of the electronic lock 1, where the inner cover of the case 3 has been removed and where a printed circuit board 12 with different electronic components can be seen. Particularly, the printed circuit board 12 is provided with an electronic control module 13 8e.g. a microcontroller or microprocessor), an RFID reader module 14 (which could also be an NFC reader or an RFID/NFC reader), an RF antenna 15 which makes it possible to receive RFID identification signals and/or NFC communication technology (in case RFID and NFC are required, the same RF antenna is used for both technologies), and a wireless communication module 16 (a module using WiFi technology, in a preferred embodiment). FIG. 2B is a perspective view of the inner part of the lock showing a compartment 40 for the battery supply module, which can be formed by conventional batteries, a battery unit, a rechargeable battery or any other autonomous power supply source.

Figure 3:
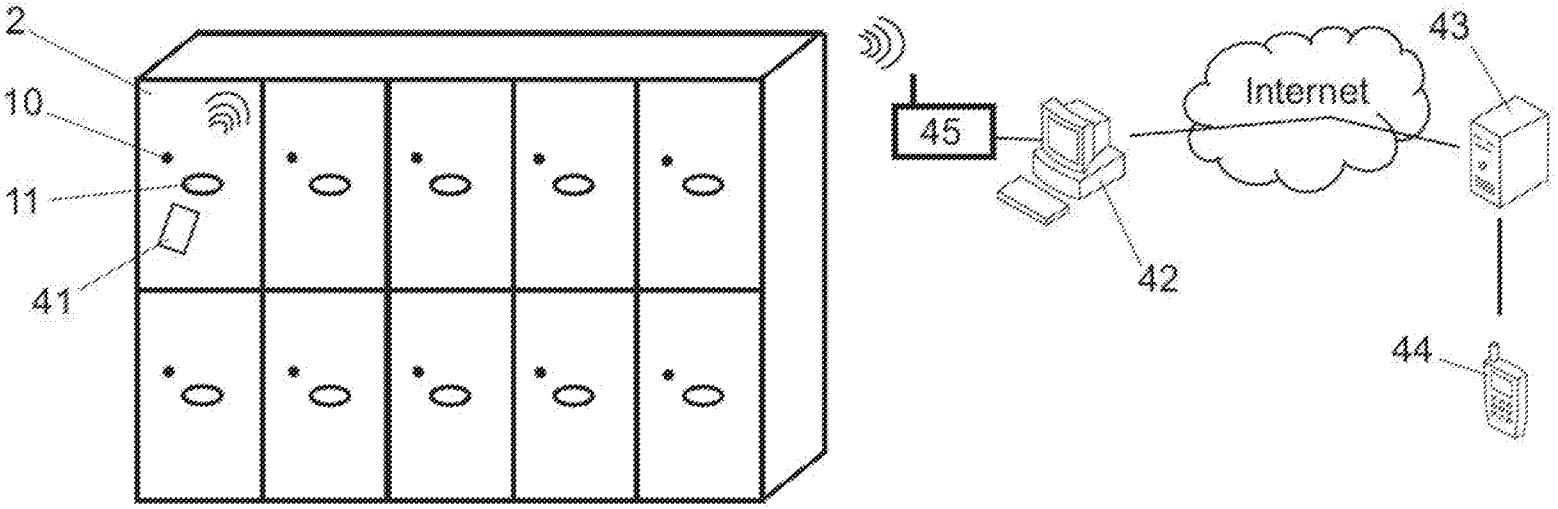
FIG. 3 shows a system of electronic locks installed in a set of lockers, in communication with a central control unit.

FIG. 3 represents a locker system, wherein each of the lockers is fitted with an electronic lock 1 according to the present invention. In the case shown, the electronic locks are activated with a passive RFID card 41, that the user must place close to the indication 11 so that the RFID reader 14 of the lock, with the RF antenna 15 located inside the locker at about the same height of the indication 11, reads the data stored in the RFID card 41 and the locker can be opened or locked.

The electronic lock 1 of each lock communicates wirelessly with a central control unit 42, preferably using an intermediate wireless router 45, with a wireless communication module, for example a module with WiFi technology, compatible with the locks 1 wireless communication module 16. The central control unit 42 is an electronic device intended for the control of a plurality of locks. In alternative embodiments, an installation can be provided with several central control units, each one of them controlling a set of locks or else featuring autonomous decision making or being ruled by a global control unit (in this case the central control unit would be local units reporting to a general control unit from the installation). The central control unit 42 can operate locally or in an isolated fashion, although in other alternative embodiments it could be accessed through the Internet, using for example a server 43 which allows management of communications with the user mobile devices 44. There is also the possibility, when there are several control units, that each of them features the possibility to control all the locks (for example, remote control units through the Internet). In this case, it can be configured which one has management priority, if the first in giving a response or one in particular.

This electronic lock system, formed by the different electronic locks 1, has a minimum consumption compared to the wired systems, since practically consumption and actions only take place when a lock is activated. The electronic lock 1 is kept in stand-by all the time when an enhanced autonomy of the lock is intended. When a user comes close with an RFID key (e.g., RFID card 41 or RFID bracelet), the lock control module 13 wakes the electronics of the lock up thanks to the RF antenna 15. The electronic lock 1 only communicates with the server when needed, thus reducing the consumption by the communications.

The electronic lock 1 is continuously in standby, waiting for an RFID key to come closer (e.g. a user card or bracelet) or a mobile device fitted with NFC communication technology.

Meanwhile, it keeps emitting periodically through the RF antenna a minimum signal searching for the RFID card. The consumption is optimized by the internal management of the lock activity and optimizing the periodicity of the signal emission. The RFID reader 14 is the only element which is held active in minimum mode of operation. Since the RFID card 41 is passive, the lock 1 searches for it in minimum mode of operation, energizing the RF antenna 15 about twice per second to check if there is an RFID and/or NFC tag or key in the antenna field and, if this is the case, activate the rest of the electronic components of the lock: the WiFi module 16, the microprocessor 13, the memory, etc.

The activation of the lock is carried out by detecting variations in the field received through the RF antenna 15 for contactless proximity identification by radio frequency located inside the locker, and therefore non-visible from outside. The RF antenna 15 of the lock generates the required energy being transmitted to the coil of the RFID card 41 so as to generate enough current for it to respond with the required data. The RF antenna 15 is suitable for use with doors having different thickness from 1 mm to 22 mm, wherein doors made of different materials (wooden, phenolic) are possible, except for metallic doors which hinder radio frequency communication.

Figure 4A:
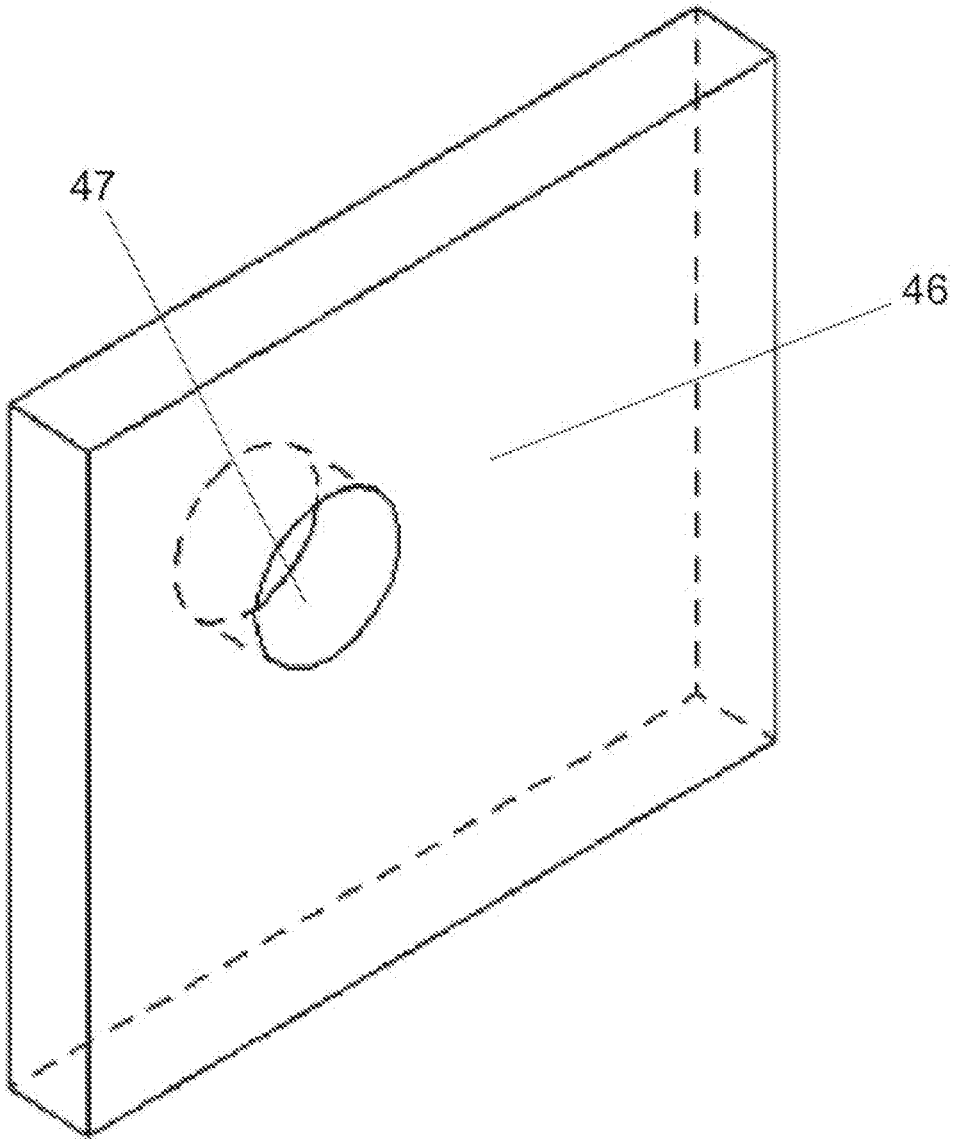
FIGS. 4A and 4B show the installation of an RF antenna in the through hole of a metallic door.
Figure 4B:
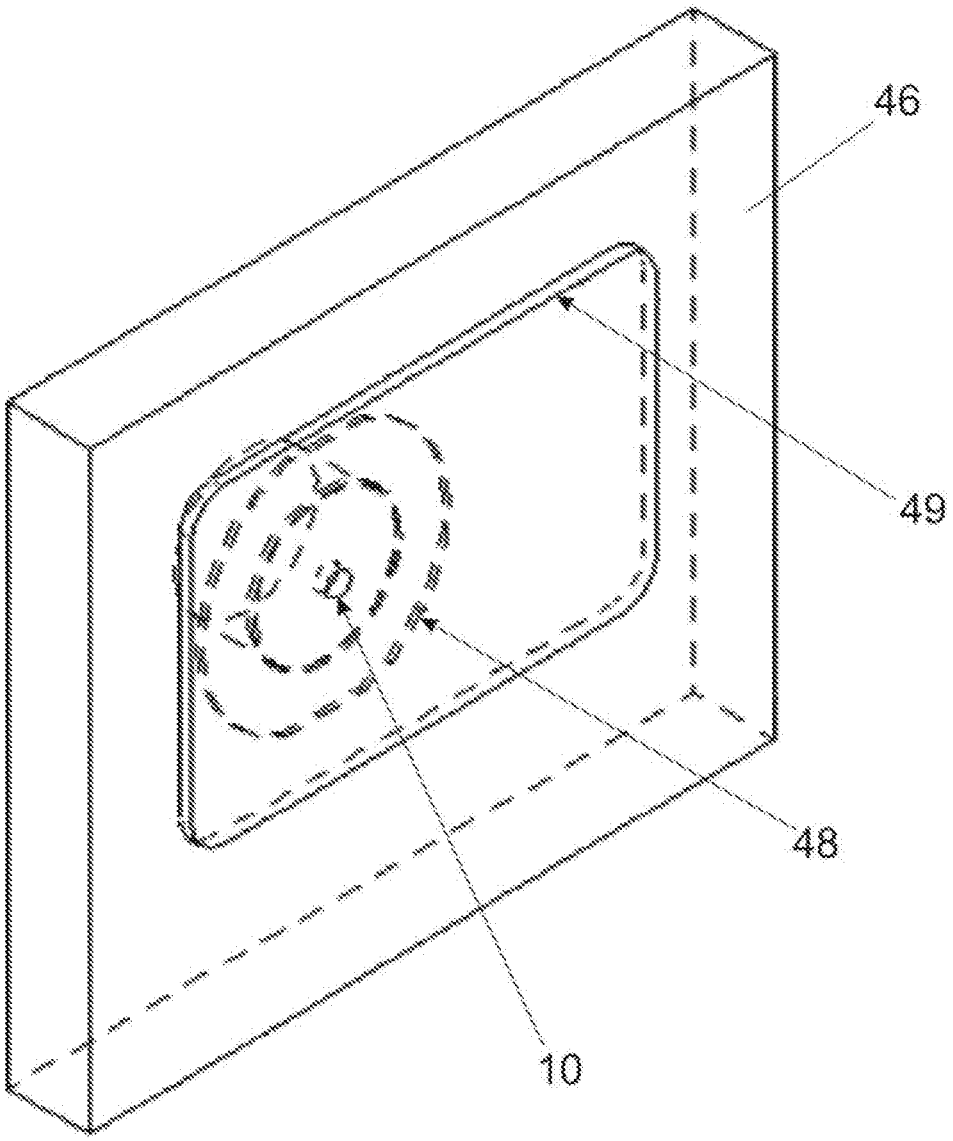

In case the cabinet is metallic, a cylinder or tumbler standard through hole is used to let the RF antenna come out and the place is indicated with a sticker underneath which the hole with the antenna is located (isolated from the sheet surrounding it). FIG. 4A shows a metallic door 46 with a through hole 47. FIG. 4B represents the metallic door 46 having an RF antenna 48 installed with an additional crown of the "booster" type (amplifier) which serves as a link. The antenna 48 is incorporated in an outer plate 49.

When a user brings closer the RFID bracelet or card 41, they use a single gesture to move the card or bracelet closer, and the RF antenna 15 detects that movement. The RF antenna sends an electric signal to the RFID reader 14 of the lock, which in turn wakes the lock electronics up. From that moment on, the proximity identification interface starts working, that is, the RFID reader which retrieves the information contained in the RFID card or bracelet and which allows the identification of the user, by sending said information to the control module 13 for the verification thereof.

If the electronic lock 1 is operating in "online" mode, then it sends wirelessly the required information extracted from the card to the central control unit 42, being provided with management software which verifies if the lock opening or locking can be authorized or not, as appropriate. After the verification, the central control unit 42 sends the due command to the control module 13 of the lock, which acts consequently. If the RFID card 41 user is given the adequate authorization, the command will be opening or locking the lock. Otherwise, the central control unit 42 will deny the access to the locker. Therefore, it is the lock 1 which activates the opening/locking system and not the central control unit 42, which cannot interrogate the lock 1, generating a dramatic reduction of the consumption. In an installation being provided with different applications, this method can be used to transmit other data contained in the RFID card to the central control unit, managing other applications at the same time (for example, credit management or personal information updating).

In case the electronic lock 1 is not working in an "online" mode, either because it has temporarily lost communication with the central control unit 42 or because the electronic locks are configured to work in the offline ("stand-alone") mode, the control module 13 of the lock is provided with a whitelist having valid card/bracelet identification parameters. If the identification data read from the RFID card or bracelet correspond to those in the whitelist of identification parameters, the control module 13 proceeds with the opening or locking. The same operation can be performed using a blacklist, that is, a list containing the identification data from cards/bracelets which the locks are not intended to operate with. If neither a whitelist nor a blacklist is desired to be used, the lock stores all the required data anyway when the last locking operation has been done. Thus, if communication with the central unit is lost, the lock can act in the same way as a "stand alone" lock: if a user authorized to open a lock gets close to the lock, this wakes up, tries to communicate with the central unit and, if it cannot do it, it generates an error event in the communication with the central unit and turns to operate in the "stand alone" mode, and it proceeds with the opening action after verifying the data stored in the card and in the lock itself.

The lock can operate in a combination mode, in which if the lock 1 is online then it is the control unit 42 that controls the opening or locking actions, although the lock 1 keeps a copy of the whitelist or the blacklist and is provided with the logic to decide what to do based on the content of the RFID card. If after communicating with the central unit there is no connection, the lock 1 can operate autonomously to identify the user permissions or the group of users and their permissions, because the card identifiers list and the permissions thereof are distributed.

The electronic locks 1 form a network with the router 45. The router 45 is capable of managing the communication with a great number of locks. If necessary, routers can be used to cover all the locks in the facility. The locks consumption is also reduced to optimize the configuration of both the beacon time ("beacon") and the delivery traffic indication messages "DTIM" of the network at periods higher to the standard ones, so that the locks do not have to activate so often to keep the connection going on.

Once installed in the furniture, the locks are configured to be connected to the network. The static parameters of the locks (associate the lock to the locker number, for example), can be registered thanks to a NFC programming device or with a programming card. This initial configuration can also be pre-programmed during the manufacturing process of the lock itself, allowing then an automatic configuration in the facility. Once the network configuration has been established from the initial configuration data, all the remaining parameters that the lock 1 requires to work are received automatically through the network.

In the network, the locks 1 are the elements controlling the communication, that is, the lock 1 always initiates communication with the central control unit 42, guaranteeing a better management for the use of the lock battery 1. Thus, the lock can be permanently in standby and be only activated when a user is near, or after an alert event (for example, a non-authorized attempt to manipulate the lock) or at a pre-set time. By bringing the RFID closer to the door, the user wakes the lock up and at that moment the lock operates. Furthermore, the lock 1 wakes up periodically for checking purposes with the central control unit 42 and updating the system, but the activation period is adapted to enhance the length of the batteries.

Wireless communication is used between router 45 and the locks 1, preferably via WiFi. Preferably, the TCP/IP protocol is used as communication protocol, which grants direct access to the lock without using intermediate equipment.

Figure 5A:
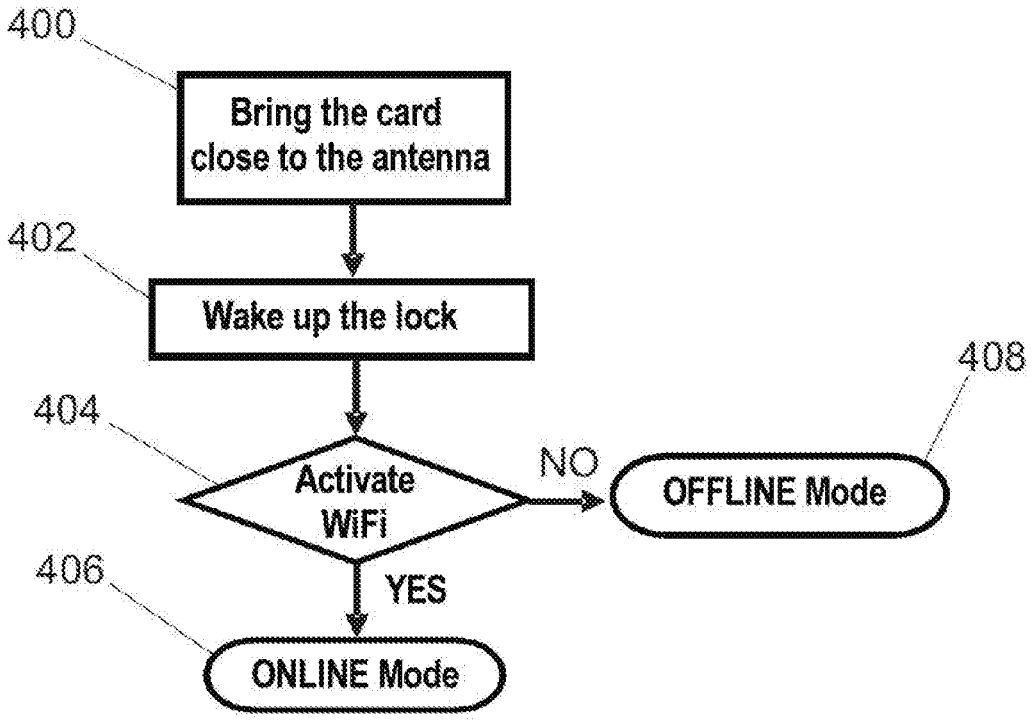
FIGS. 5A, 5B and 5C show flow diagrams of the locks system operation.

FIG. 5A represents a flow diagram of the lock system operation, according to a possible embodiment. The user brings 400 the RFID card 41 closer to the indication 11 on the locker door 2. The F antenna 15 of the lock 1 energizes the RFID card 41 and the presence thereof is detected, waking up 402 the lock 1 (at least waking up the control module 13). The control module 13 of the lock 1 verifies 404 if the WiFi communication module must be activated, in which case the online mode 406 is activated (the lock in communication with the central control unit 42), and in the opposite case in the offline mode 408 (the lock in isolate or autonomous operation, without communicating with the central control unit 42).

Figure 5B:
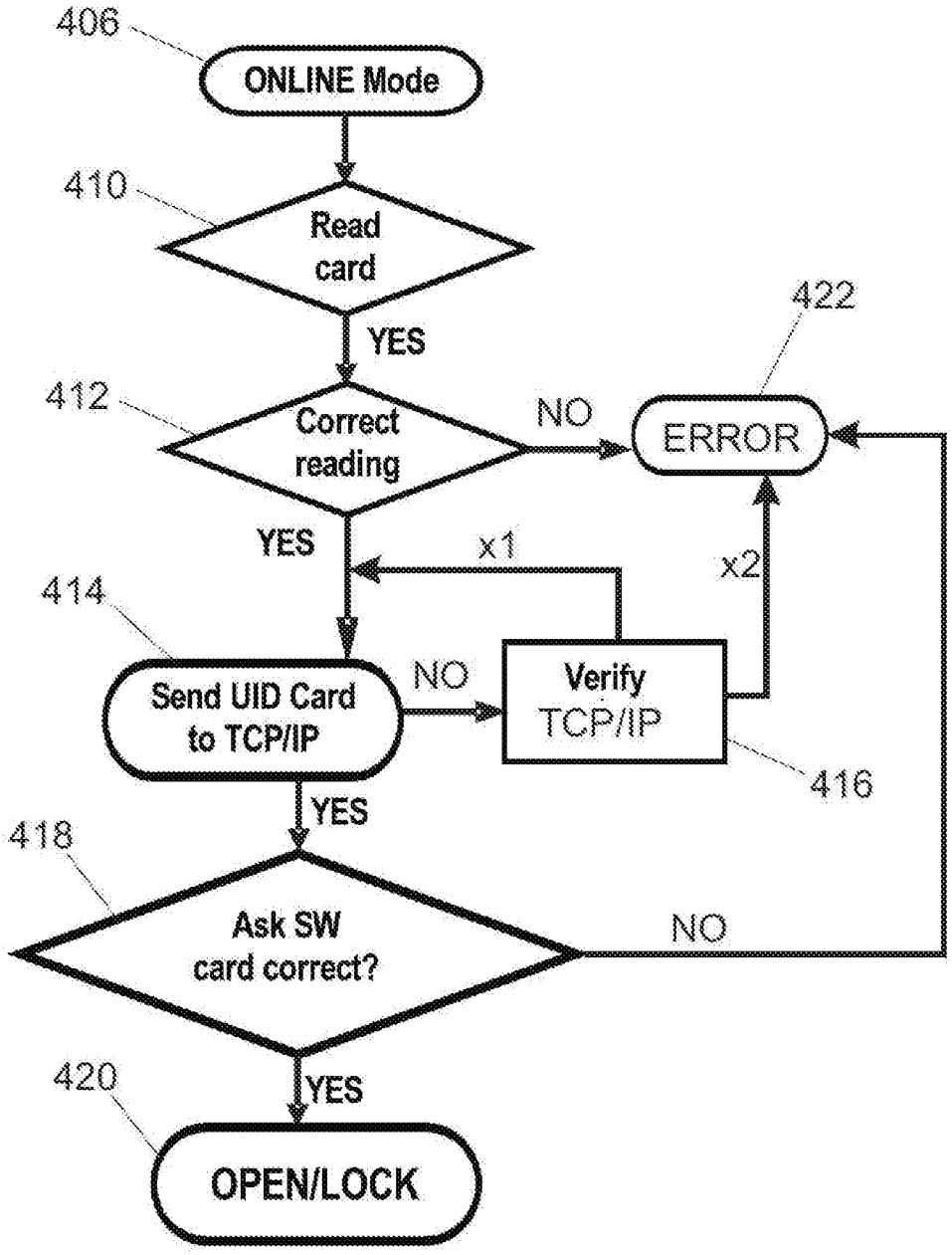

Operation in the online mode 406 is shown in the diagram in FIG. 5B. In the online mode 406 the RFID card 41 is read 410 (reading of access data may involve, inter alia, for example, an identifier of the RIFD card and/or an access code). Then, the system checks if the reading is correct 412, in which case the identification data of the RFID car are sent 414 to the central control unit 42 by means of TCP/IP protocol. If the sending event is incorrect 416 the link TCP/IP is checked and if it is correct the central control unit 42 is asked if the RFID card 41 is granted permission to open the lock 1, by sending the access data wirelessly. In case the RFID card 41 is granted permission, opening or locking 420 of the lock can occur, as appropriate. In case the RFID card reading 412 or the TCP/IP link checking 416 is incorrect, or the RFID card is not granted permission to activate the lock, an error alert 422 for the user takes place, for example, by means of a red LED or a sound alert. Whatever the action is, the corresponding event is registered both in the lock 1 and in the central control unit 42.

Figure 5C:
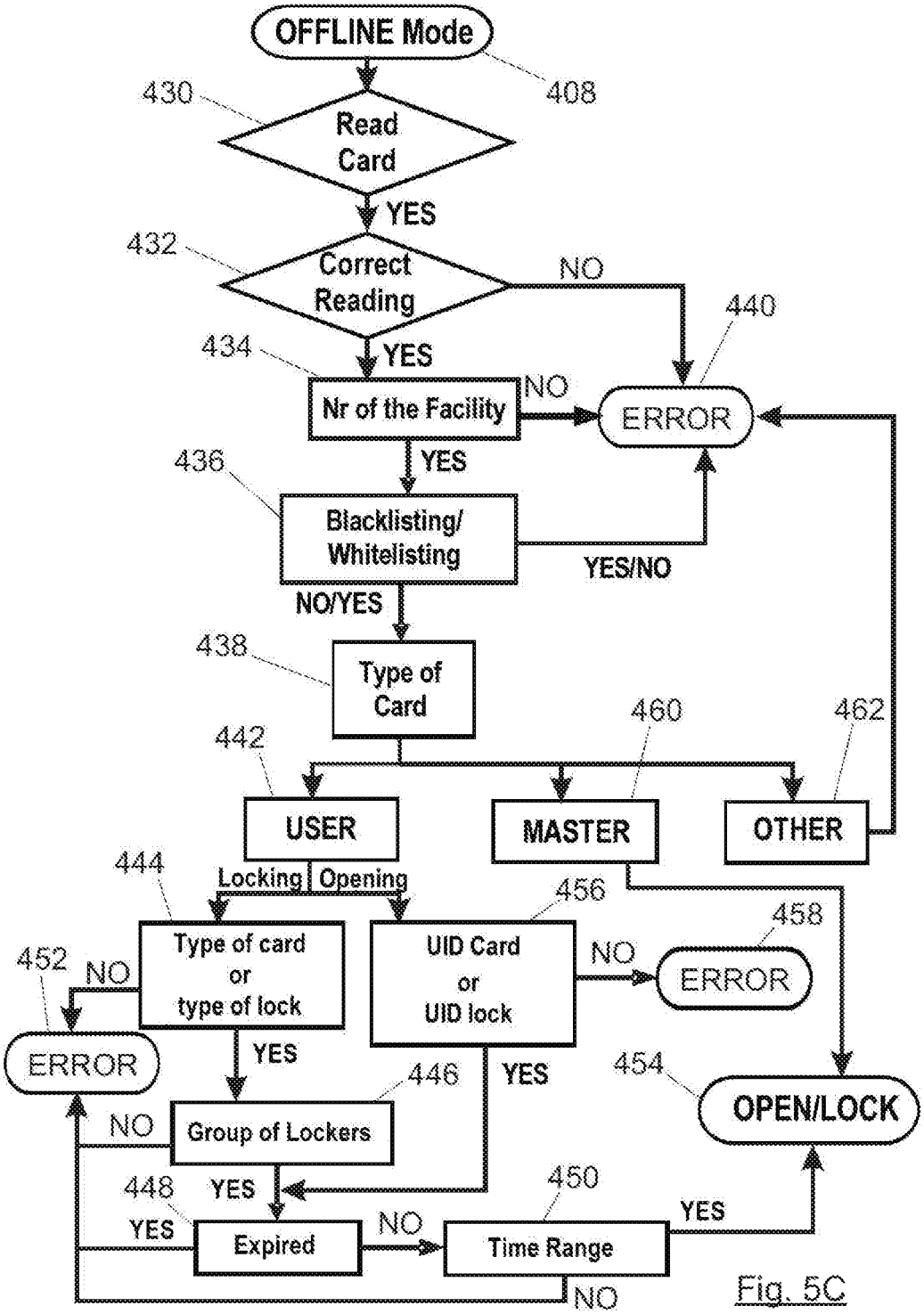

FIG. 5C shows operation of the lock 1 in the offline mode 408. The offline mode 408 starts by reading 430 the RFID card 41. It is verified that the reading is correct and then an identifier corresponding to the facility number 434 is read and it is verified 436 if said identifier is included in the whitelist or in the blacklist stored in an inner memory of the lock 1 (the facility number stored in a card prevents a card from being used in several different facilities). If included in the whitelist, then identification of the type of card 438 is carried out. If on the contrary it is included in a blacklist or an error would have occurred when reading the card, an error event 440 takes place and the user is notified (using, for example, a LED, a display or a sound alert). In this case, the lock 1 also registers the event that has taken place.

If the type of card detected is a user card 442 and the lock is opened, it is checked if a locking operation should take place. In order to do so, the system checks if the type of card corresponds to the type of lock, that is, if the type of card is granted permission 444 to operate the particular lock (for example, in a sport facility having a swimming pool and a gym there may be a type of cards to operate the gym lockers and another type of cards to operate the swimming pool lockers). If permission is granted, then there is a verification to check if the group of lockers 446 is correct (in a changing room access can be granted for a group of lockers but not granted for another group of lockers; for example, only members of a club are granted access to a private locker area and not occasional users which are not members), and if the card permissions are not expired 448. Next, the time range 450 is verified, since in the sport facilities it is important to manage times somehow (for example, in a facility opening from 08:00 to 21:00, the locks are not used in the same way: out of that time range opening of the locks is allowed but locking them is not, whereas within that time range both opening and locking of the locker is allowed). In case an error occurs 452 the user is alerted; otherwise, if everything is correct the lock is locked 454 and the corresponding event is stored.

If the RFID card is a user card 442 and the lock is held locked, then it is checked if an opening operation can take place. In order to do so, the control module 13 of the lock verifies if the card identifier coincides with the lock identifier, if the temporary permission of the card has not expired 448 and if the times 450 are correct, in which case the lock is opened 454, and in case there is any type of error (452, 458) the user is notified.

If the user RFID card is a master card 460, the lock van be opened or closed, as appropriate. In case the type of RFID card is of a different type 462, neither a user's nor a master card, the user is notified about the error 440.

Figure 6:
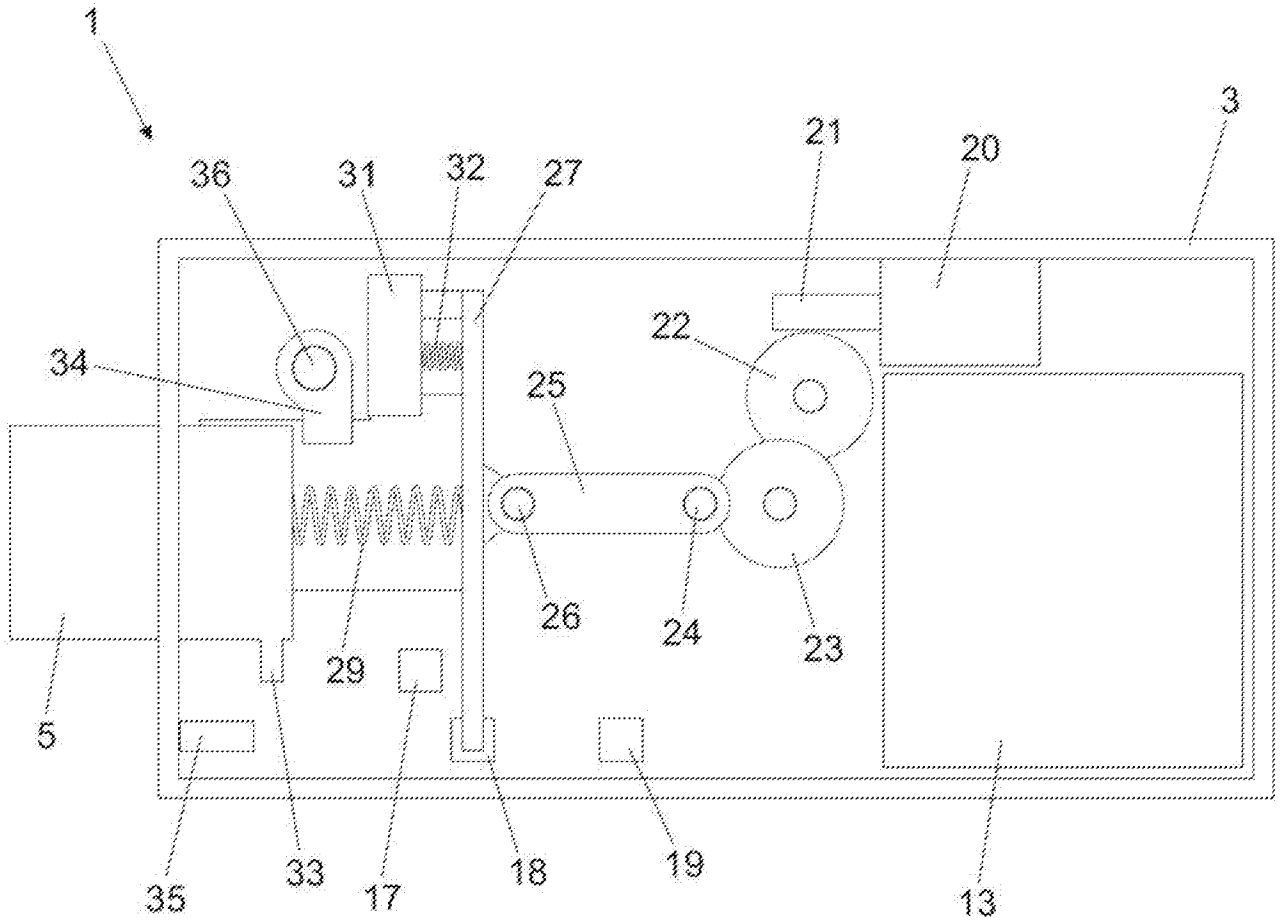
FIG. 6 shows a schematic front view of the elements of the lock automatic opening and locking system according to a possible embodiment, with the locking element in the locked position thereof.

FIG. 6 shows an schematic front view of an automatic opening and locking system for the lock, which does not require of a manual actuator (for example a knob) for the user to open or lock the lock. Said FIG. 6 represents the locking element 5 in a locked position. In a possible embodiment the automatic opening system comprises an electric motor 20 actuating an endless screw 21 located at the motor axis, a plate 23 connected to the endless screw 21 through a transmission mechanism 22 (e.g., a toothed wheel), and a rod 25 integral to the plate 23 by its ends at a particular point 24 in the peripheral area thereof. Rotation of the endless screw 21 causes rotation of the plate 23, generating the lineal movement of the other end 26 of the rod 25, being this integral to a movable carriage 27 featuring linear movement along the guides (not shown in the figure).

Coupled to the movable carriage 27 there is a locking element 5 (a tab or latch) featuring relative mobility with respect to the movable carriage 27 in the moving direction thereof due to a first elastic element 29 (for example, a spring or fluid cushioning) located between the movable carriage 27 and the locking element 5. Thus, during the locking movement of the lock the movable carriage 27 pushes the locking element 5 by the action of the first elastic means located between both parts, allowing the first elastic element 29 to perform a recovery movement if the locking element 5 finds any obstacle along the stroke thereof or if it is not correctly inserted in the outer groove 9, thereby not forcing the motor 20 and avoiding possible blockage of the locking mechanism. While in FIG. 6 the mechanism activating the movable carriage 27 is a linear and cam motor mechanism, other alternative embodiments to cause a linear movement of the movable carriage 27 are possible.

There is also a pusher 31, coupled to the movable carriage 27, which features relative mobility with respect to the movable carriage 27 in the moving direction thereof, due to a second elastic element 32 (e.g., a spring or a fluid cushioning) located between the movable carriage 27 and the pusher 31. The electronic lock also comprises a blocking trigger 34 that rotates around an axis 36 thus defining a blocking position and an unblocking position. When the locking element 5 is in the opening position, the blocking trigger 34 is placed in the unblocking position thereof, whereas when the locking element 5 is in the locking position the blocking trigger 34 is places between the locking element 5 and the pusher 31, as it can be seen in FIG. 6, thus blocking the locking element 5 movement and the pusher 31 acting as a stop for the blocking trigger 34. Thus, when the blocking trigger 34 is in the blocking position thereof and the locking element 5 is forced to be moved from the locking position to the opening position thereof, said locking element 5 abuts against the blocking trigger 34 that in turn abuts against the pusher 31, hindering the displacement thereof towards the opening position of the locking element 5. The blocking trigger 34 when in blocking position, is not in direct contact with the locking element 5, but there is a gap or separation (as it can be seen in FIG. 6) that allows a relative backward movement of the locking element 5 with respect to the movable carriage 27).

Detection of the locking element 5 positioning is carried out by using three optical or magnetic positioning sensors: a blocking sensor 17, a locking sensor 18 and an opening sensor 19. In a preferred embodiment, the sensors are optical, so as to be able to detect the locking element 5 position thanks a light emitted by the sensor itself being reflected in an arm 33 (projection or flange) of the locking element 5. The locking sensor 18 is intended to detect the locked position of the lock, by detecting the presence of the movable carriage 27 (while the other sensors do not detect presence). The opening sensor 19 is intended to detect the opening position of the lock, by detecting the presence of the movable carriage 27 at the same time the blocking sensor 17 is detecting the presence of the arm 31 of the locking element 5. On the other hand, the blocking sensor 17 identifies a blockage in the lock or a violation attempt to the lock, by detecting the presence of the arm 31 of the lock: open, locked or blocked.

The blocked position helps determine if there is an obstacle hindering the movement of the locking element 5 (presence of an obstacle along the tab stroke, for example) or if there is an violation attempt taking place from the outside to the locking element 5.

Thus, for example, when the locking element is in the opening position and there is an obstacle in the way blocking the locking element 5 from coming out, when the command is given for a locking action so as to turn from the opened position to the locked position, the movable carriage moves forward to the locking position. Due to the blockage being done by the obstacle, the locking element 5 cannot advance, which urges the first elastic element 29 to get compressed absorbing the movable carriage 27 displacement, with the blocking sensor 17 remaining activated. Likewise, the blocking trigger 34 cannot rotate over the axis 36 thereof since the locking element 5 does not allow so. In this situation, the pusher 31 contacting the blocking trigger 34, compresses the second elastic element 32, which also absorbs the displacement of the movable carriage 27. While the obstacle is present, thanks to the several sensors (17, 18, 19) the control module 13 recognizes in real time that the locking element 5 of the lock has been electronically locked but has not been mechanically locked, since the locking sensor 18 is being activated by the movable carriage 27 that has placed in the locking position, but with the blocking sensor 17 still activated as the locking element 5 has not been able to move to the locking position because of the presence of an obstacle. Once the obstacle has been removed, the locking element 5 moves to the locking position driven by the first elastic element 29, and at the same time the pusher 31 places the blocking trigger 34 in the blocking position thereof with the assistance of the second elastic element 32, as the locking element 5 is not in contact with it anymore and is not interfering in the movement thereof. In this situation, the control module 13 recognizes in real time when the obstacle has been released, since the blocking sensor 17 detects it as it is not activated, without requiring elements out of the lock itself or the user action.

The forced movement of the locking element 5, from the locking position to the opening position, is carried out until the locking element 5 abuts against the blocking trigger 34, provoking a change in the blocking state of the blocking sensor 17 and generates the identification of non-authorized tampering action from the control module 13. This situation corresponds to an attempt to force the lock from the outside when attempting to press the locking element 5 towards the inner part of the electronic lock 1. In this case the electronic lock 1, based on a pre-determined configuration, can keep the lock in a locked position or open the lock to avoid that tampering the locking element 5 causes damage in the inner mechanism of the lock itself. Optionally, the control module 13 activates a local or remote alert to notify non authorized manipulation.

FIG. 6 also shows the magnetic sensor 35 intended to detect the magnet 7 located in the inner side wall 8 of the locker, so as to determine if the locker door 2 is open or closed. To avoid magnetic difficulties, the magnetic sensor based on a magnet can be substituted by a reed sensor.

Figure 7:
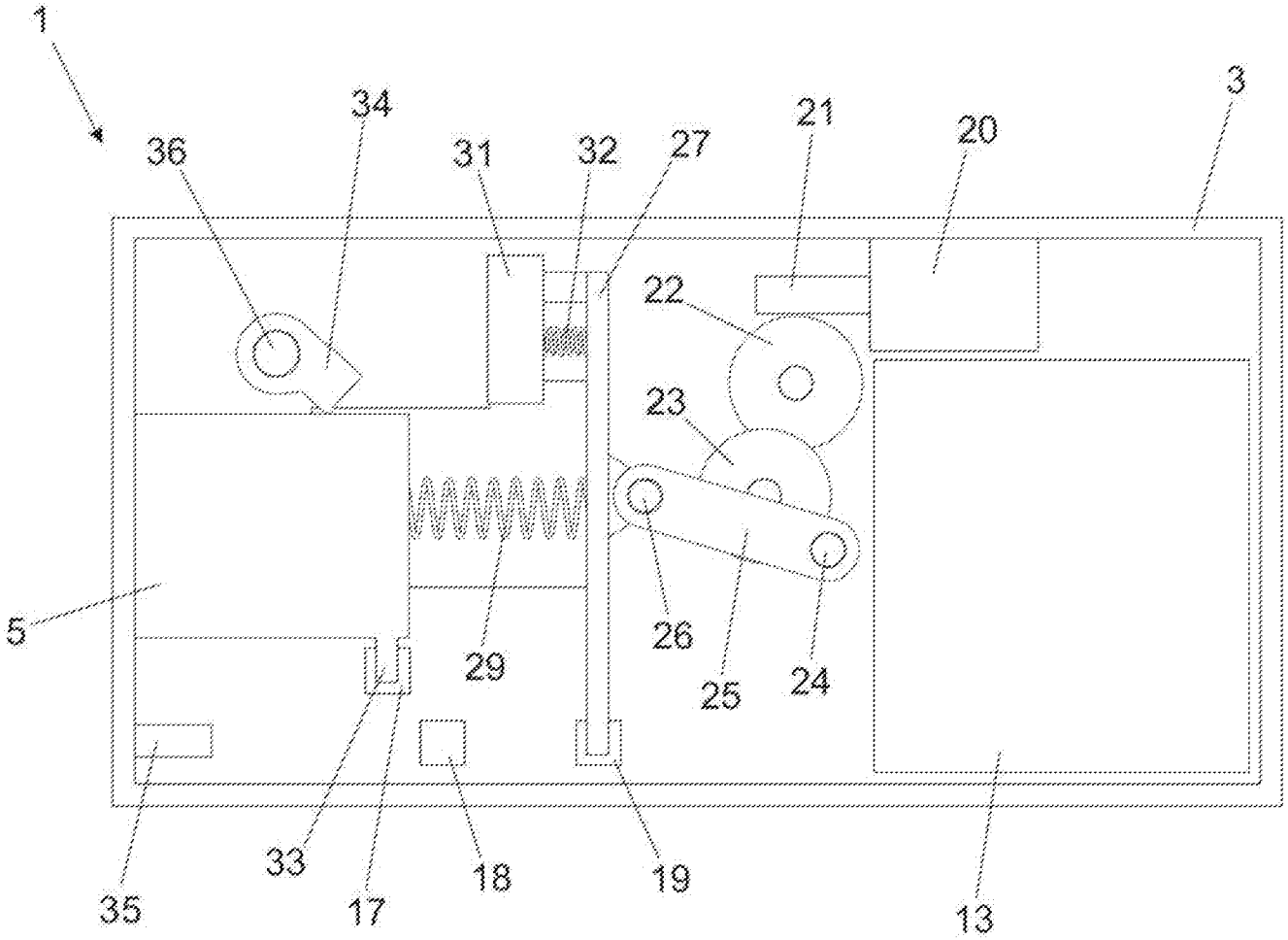
FIG. 7 shows a front view of the electronic lock of FIG. 6 with the locking element in the opening position.
Figure 8:
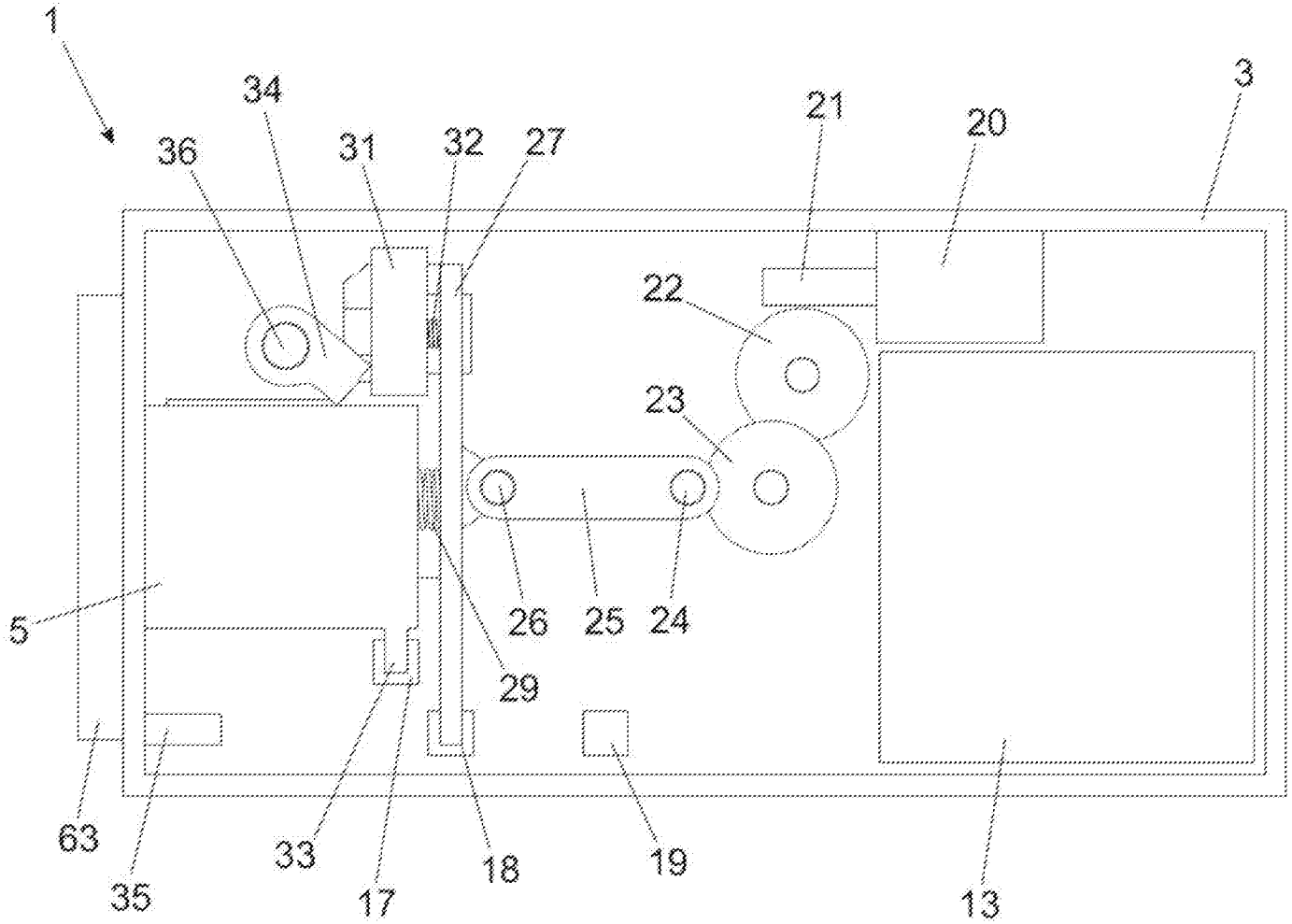
FIG. 8 shows a front view of the electronic lock of FIGS. 6 and 7 with the locking element in the blocked position thereof, since an obstacle prevents the locking element from advancing.

FIG. 7 represents the lock 1 of FIG. 6 in an opening position, whereas FIG. 8 represents, for the same lock 1, an obstacle 63 hindering the advance of the locking element.

FIGS. 6, 7 and 8 show the positioning sensors of the locking element, in particular the blocking sensor 17, the locking sensor 18 and the opening sensor 19. The locking of the lock is detected by the sole activation of the locking sensor 18 (see FIG. 6), which detects the lower end of the movable carriage 27. On the contrary, the opening of the lock is detected by simultaneous activation of the blocking 17 and opening 19 sensors (see FIG. 7), which detect the lower arm 33 of the locking element 5 and the lower end of the movable carriage 27, respectively. Finally, the blocking situation of the lock, due to the presence of an obstacle 63 hindering the advance of the latch 5, is detected by the simultaneous activation of the blocking 17 and locking 18 sensors (see FIG. 8), which detect the arm 33 of the locking element 5 and the lower end of the movable carriage 27, respectively.

The invention claimed is:

1. Electronic lock for furniture, cabinets or lockers, comprising:

a case having means for the fixing thereof to an inner part of a door of a piece of furniture, cabinet or locker;

a locking element electronically activated;

a power module being supplied by at least one battery;

an electronic access means for receiving access data, wherein the electronic access means are RFID and/or NFC proximity wireless means and comprise an RF antenna and an RFID and/or NFC reader;

a wireless communication module; and an electronic control module configured to operate the lock in any of the following modes of operation:

an offline mode, by means of which the locking element is autonomously activated based on the access data received; and an online mode, by means of which the access data being received are sent to a central control unit and the activation of the locking element is performed based on the activating instructions remotely received from said central control unit, the lock automatically operating in an offline mode under conditions of a failure event in the communications with the central control unit;

wherein the RFID and/or NFC reader is configured to periodically energize the RF antenna and, in case of detecting an RFID and/or NFC identification, wake up the electronic control module of the lock.

2. Electronic lock according to claim 1, wherein the furniture, cabinet or locker where the lock is installed has a metallic door, and wherein the RF antenna is mounted in a through hole of the metallic door.

3. Electronic lock according to claim 1, wherein the electronic access means comprises a module with means for the attachment thereof to the front side of the door and being configured to communicate with the electronic control module, said electronic access means including at least one of the following means:

a keypad;

an infrared reader;

a biometric reader.

4. Electronic lock according to claim 1, wherein the electronic lock is adapted to communicate with the central control unit upon a request from the lock, keeping the wireless communication module deactivated when there is no communication going on.

5. Electronic lock according to claim 1, comprising means for detecting the state of the lock being connected to the electronic control module, and comprising a blocking sensor, a locking sensor and an opening sensor to detect three possible different positions of the locking element: open, locked or blocked.

6. Electronic lock according to claim 1, comprising a locked door detector.

7. Electronic lock according to claim 6, wherein the means for detecting the locked door comprise a magnetic sensor or a reed type sensor accommodated in a cavity drilled in the side wall of the case in which the locking element is located, being said magnetic sensor connected to the electronic control module to determine if the door is locked by detecting a magnet fixed to the inner side wall of the piece of furniture, cabinet or locker.

8. Electronic lock according to claim 6, wherein the electronic control module is configured to identify non-authorized tampering of the furniture, cabinet or locker by detecting the opening of the door when a locking element is in a closed position, and to generate a warning alert.

9. Electronic lock according to claim 1, comprising an ultrasound sensor or a PIR volumetric sensor connected to the electronic control module to detect if the inner part of the piece of furniture, cabinet or locker is empty or taken.

10. Electronic lock according to claim 1, wherein the wireless communication module is a WiFi module.

11. Electronic locking system for furniture, cabinets or lockers, comprising:

a plurality of electronic locks according to claim 1;

at least a control unit in communication with the electronic locks and configured to, upon reception of access data sent wirelessly from an electronic lock:

verify if said access data grant permission to operate the electronic lock, and send activation instructions for the locking element to the electronic lock based on said verification.

12. Electronic locking system according to claim 11, comprising a central control unit.

13. Electronic locking system according to claim 11, comprising a plurality of distributed control units.

14. Electronic locking system according to claim 11, wherein the electronic locks and at least a control unit form a local or wide area configurable network.

15. Electronic lock for furniture, cabinets or lockers, comprising:

a case having means for the fixing thereof to an inner part of a door of a piece of furniture, cabinet or locker;

a locking element electronically activated;

a power module being supplied by at least one battery;

a wireless communication module;

an electronic control module configured to operate the lock in any of the following modes of operation:

an offline mode, by means of which the locking element is autonomously activated based on an access data received; and an online mode, by means of which the access data being received are sent to a central control unit and the activation of the locking element is performed based on the activating instructions remotely received from said central control unit, the lock automatically operating in an offline mode under conditions of a failure event in the communications with the central control unit;

and an ultrasound sensor or a PIR volumetric sensor connected to the electronic control module to detect if the inner part of the piece of furniture, cabinet or locker is empty or taken.

16. Electronic locking system for furniture, cabinets or lockers, comprising:

a plurality of electronic locks according to claim 15;

at least a control unit in communication with the electronic locks and configured to, upon reception of access data sent wirelessly from an electronic lock:

verify if said access data grant permission to operate the electronic lock, and send activation instructions for the locking element to the electronic lock based on said verification.

* * * * *